US006130653A

United States Patent [19]

Powers, Jr. et al.

[11] Patent Number: 6,130,653

[45] Date of Patent: Oct. 10, 2000

[54] COMPACT STRIPLINE ROTMAN LENS

[75] Inventors: Billy Powers, Jr., Richardson; Randy J. Richards, Frisco, both of Tex.

[73] Assignee: Raytheon Company, Lexington, Mass.

[21] Appl. No.: 09/163,593

[22] Filed: Sep. 29, 1998

[51] Int. Cl.[7] ..... H01Q 15/08

[52] U.S. Cl. ..... 343/911 R; 343/909

[58] Field of Search ..... 343/911 R, 909, 343/753, 754, 785; H01Q 19/06, 15/04

[56] References Cited

U.S. PATENT DOCUMENTS

| | | | |
|---|---|---|---|
| 3,761,936 | 9/1973 | Archer et al. | 343/754 |
| 4,381,509 | 4/1983 | Rotman et al. | 343/754 |
| 4,490,723 | 12/1984 | Hardie et al. | 343/754 |
| 4,641,144 | 2/1987 | Prickett | 343/754 |
| 4,721,966 | 1/1988 | McGrath | 343/754 |
| 4,899,164 | 2/1990 | McGrath | 343/754 |
| 5,495,258 | 2/1996 | Muhlhauser et al. | 343/753 |
| 5,675,345 | 10/1997 | Pozgay et al. | 343/754 |
| 5,936,588 | 8/1999 | Rao et al. | 343/754 |

FOREIGN PATENT DOCUMENTS

| | | | |
|---|---|---|---|
| 61-052007 | 3/1986 | Japan | H01Q 15/02 |
| 63-142905 | 6/1988 | Japan | H01Q 15/02 |
| 2 191 344 | 12/1987 | United Kingdom | H01Q 3/26 |

*Primary Examiner*—Don Wong
*Assistant Examiner*—Hoang Nguyen
*Attorney, Agent, or Firm*—Baker Botts L.L.P.

[57] ABSTRACT

A Rotman lens (12, 13) includes a first insulating layer (26) having a high dielectric constant and a second insulating layer (46) having a low dielectric constant. Metalization provided on the first insulating layer includes a lens portion (28), and metalization provided on the second insulating layer includes a plurality of transmission lines (48) and bootlace lines (52). A plurality of via openings are provided through at least one of the insulating layers, and each contain conductive material (33, 38) which electrically couples the lens portion to a respective one of the transmission lines or bootlace lines. A number of the bootlace lines physically overlap the lens portion, without electrical engagement therewith. A ground plane (63) on a further insulating layer (61) may be provided between the first and second insulating layers, in a manner free of electrical contact with the conductive material in the via openings.

16 Claims, 6 Drawing Sheets

COMPACT STRIPLINE ROTMAN LENS

TECHNICAL FIELD OF THE INVENTION

This invention relates in general to a beam steering apparatus for an antenna and, more particularly, to a Rotman lens suitable for use in such a beam steering apparatus.

BACKGROUND OF THE INVENTION

A known multibeam antenna system includes an antenna section with a one-dimensional or two-dimensional array of beam elements, each of which can emit and receive radiation. In order to distribute a transmission signal to each of the beam elements, in a manner so that it has respective different phase shifts at the various beam elements, it is known to provide a beam-forming network which includes one or more stripline Rotman lenses.

A known Rotman lens has an electrically insulating layer which is made of a dielectric material, and has a layer of metalization provided on one side of the insulating layer. For reasons discussed later, it is desirable to minimize the size of a Rotman lens. Accordingly, and since the linear dimensions of a Rotman lens can be reduced by a factor which is the square root of the dielectric constant of the insulating layer, the insulating layer in the known lens is selected to have a high dielectric constant.

The metalization on the insulating layer includes an approximately oval-shaped lens portion, a plurality of transmission lines which are each electrically coupled at one end to a first side of the lens portion at spaced locations therealong, and a plurality of bootlace lines which are each electrically coupled at one end to an opposite side of the lens portion at spaced locations therealong. The portions of the transmission lines and bootlace lines immediately adjacent the lens portion taper in width in a direction away from the lens portion, in order to effect impedance matching between the lines and the lens portion.

In this known Rotman lens, the bootlace lines need to have certain lengths in order to effect proper operation of the Rotman lens, in particular so that signals passing therethrough experience a predetermined propagation delay. The bootlace lines are thus often laid out on the insulating layer along a path which is U-shaped or meandering, in order to achieve the desired length. As a result, there is a physical limit to the extent to which the size of the insulating layer of this known Rotman lens can be minimized, because the lens portion takes up a reasonably significant portion of the available space on the insulating layer, and the bootlace lines also take up a reasonably significant portion of this available space. The space taken up by the bootlace lines may be comparable to the space taken up by the lens portion itself.

This presents disadvantages in certain applications, where it is desirable that the Rotman lens be as compact as possible. For example, in a satellite, it is desirable that every component take up the smallest possible amount of space. As another example, a multibeam antenna may be provided on the wing of an airplane, where space is limited and a small size for a Rotman lens is highly desirable.

A further consideration, to minimize the size of the lens portion of a Rotman lens, is to fabricate the lens portion on an insulating layer which has a high relative dielectric constant in the range of about 2.5 to 300. Consequently, the insulating layer of the known Rotman lens is invariably selected to have a high dielectric constant. However, as the dielectric constant of the insulating material is increased, the width of the transmission lines and bootlace lines must be decreased in order to maintain a selected impedance characteristic, which may be 50 ohms. As a practical matter, however, the fabrication of narrow lines can present some manufacturing difficulties. Therefore, it is desirable to fabricate the transmission lines and bootlace lines on an insulating layer which has a low relative dielectric constant in the range of about 2 to 4.

Yet another consideration is that it is sometimes desirable to integrate into the known Rotman lens an arrangement commonly known as a Wilkinson combiner. However, since it is easier to fabricate a Wilkinson combiner on an insulating layer with a low dielectric constant than on an insulating layer with a high dielectric constant, because fabrication of the combiner is limited by its dimensions with a high dielectric constant, integration of a Wilkinson combiner into the known Rotman lens can present manufacturing difficulties.

One technique for reducing the size of a known Rotman lens is to physically fold it, but this has not been satisfactory in all respects.

SUMMARY OF THE INVENTION

From the foregoing, it may be appreciated that a need has arisen for a Rotman lens which is physically compact, which permits the lens portion to be fabricated on an insulating layer with a high dielectric constant, which permits the transmission and bootlace lines to be fabricated on a layer with a low dielectric constant, and/or which permits a Wilkinson combiner to be integrated into the Rotman lens without fabrication difficulties. According to the present invention, a Rotman lens has been developed to address this need, and includes: an electrically conductive lens portion; a plurality of electrically conductive lines, the electrically conductive lines including a first line and a plurality of second lines, the first line being electrically coupled at one end to the lens portion on a first side thereof, and the second lines being electrically coupled at one end to the lens portion at spaced locations along a second side thereof opposite from the first side; and an electrically insulating layer located between the lens portion and at least one of the electrically conductive lines.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
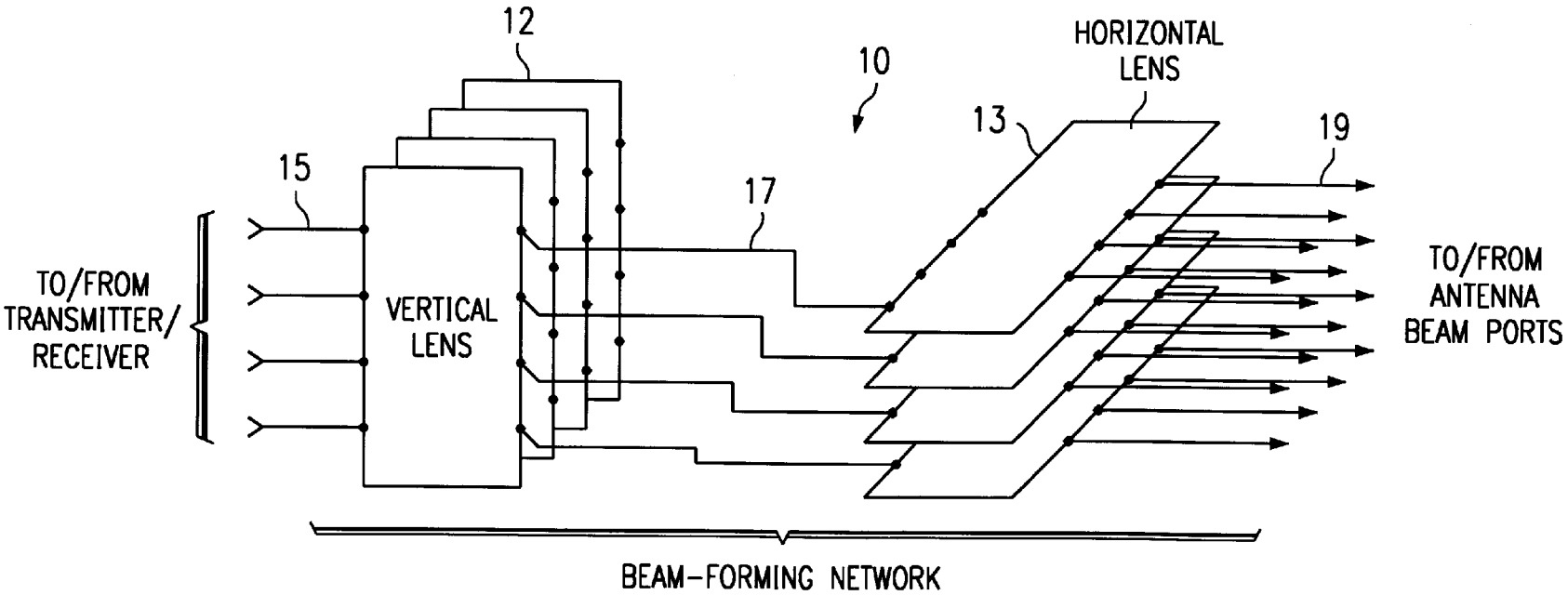
FIG. 1 is a diagrammatic view of a beam-forming network which includes several compact stripline Rotman lenses which embody the present invention.

FIG. 1 is a diagrammatic view of a beam-forming network 10, which is part of a radar or communication system having a not-illustrated two-dimensional multibeam antenna. The beam-forming network 10 includes a plurality of vertical linear Rotman lenses 12, and a plurality of horizontal linear Rotman lenses 13, the lenses 12 and 13 providing beam steering in two dimensions.

In the disclosed embodiment, and for simplicity of explanation, all of the lenses 12 and 13 are identical. However, the beam-forming network 10 could be made from lenses which are not all identical. In FIG. 1, each of the lenses 12 and 13 has a plurality of inputs and a plurality of outputs, and there are four vertical lenses 12 and four horizontal lenses 13. In the beam-forming network of FIG. 1, four inputs and four outputs are used on each of the lenses 12 and 13, although each actually has a much larger number of inputs and outputs. In a real-world application, the number of inputs and outputs used on each lens 12 or 13 would typically be substantially larger, and there would typically be more than four of the vertical lenses 12 and more than four of the horizontal lenses 13. However, in FIG. 1, the number of inputs and outputs used on each lens has been intentionally limited, in order to avoid confusion here due to complexity.

The beam-forming network 10 is coupled to a not-illustrated transmitter/receiver by sixteen lines, some of which are shown in FIG. 1, and one of which is designated by reference numeral 15. Each of the sixteen lines 15 is coupled to a respective one of the inputs on a respective one of the vertical lenses 12. The sixteen outputs from the four vertical lenses 12 are each coupled to a respective one of the sixteen inputs of the four horizontal lenses 13 by sixteen respective lines, four of which are shown in FIG. 1, and one of which is designated by reference numeral 17. The sixteen outputs of the four horizontal lenses 13 are each coupled to a not-illustrated beam element of the multibeam antenna by a respective one of sixteen separate lines, one which is designated with reference numeral 19 in FIG. 1. Each of the lines 19 is coupled to a respective beam element of the not-illustrated antenna.

For convenience, this disclosure discusses inputs and outputs of the beam-forming network 10, and inputs and outputs of the lenses 12 and 13 disposed therein. However, those skilled in the art will recognize that the beamforming network 10 is actually bidirectional. That is, the not-illustrated transmitter may send a signal on one or more of the lines 15, which passes through the lenses 12 and 13, and then through the lines 19 to the not-illustrated antenna. Alternatively, when the antenna system is in a receive mode, signals from the antenna pass through the lines 19 to the beam-forming network 10, where they pass through the lenses 13 and 12 and then through the lines 15 to the not-illustrated receiver.

One of the horizontal Rotman lenses 13 will now be described in greater detail, with reference to FIG. 2–5. Although one of the horizontal lenses 13 has been arbitrarily selected for this detailed discussion, the discussion thereof applies equally to all of the other lenses 12 and 13, because the lenses 12 and 13 are all identical in the disclosed embodiment.

Figure 2:
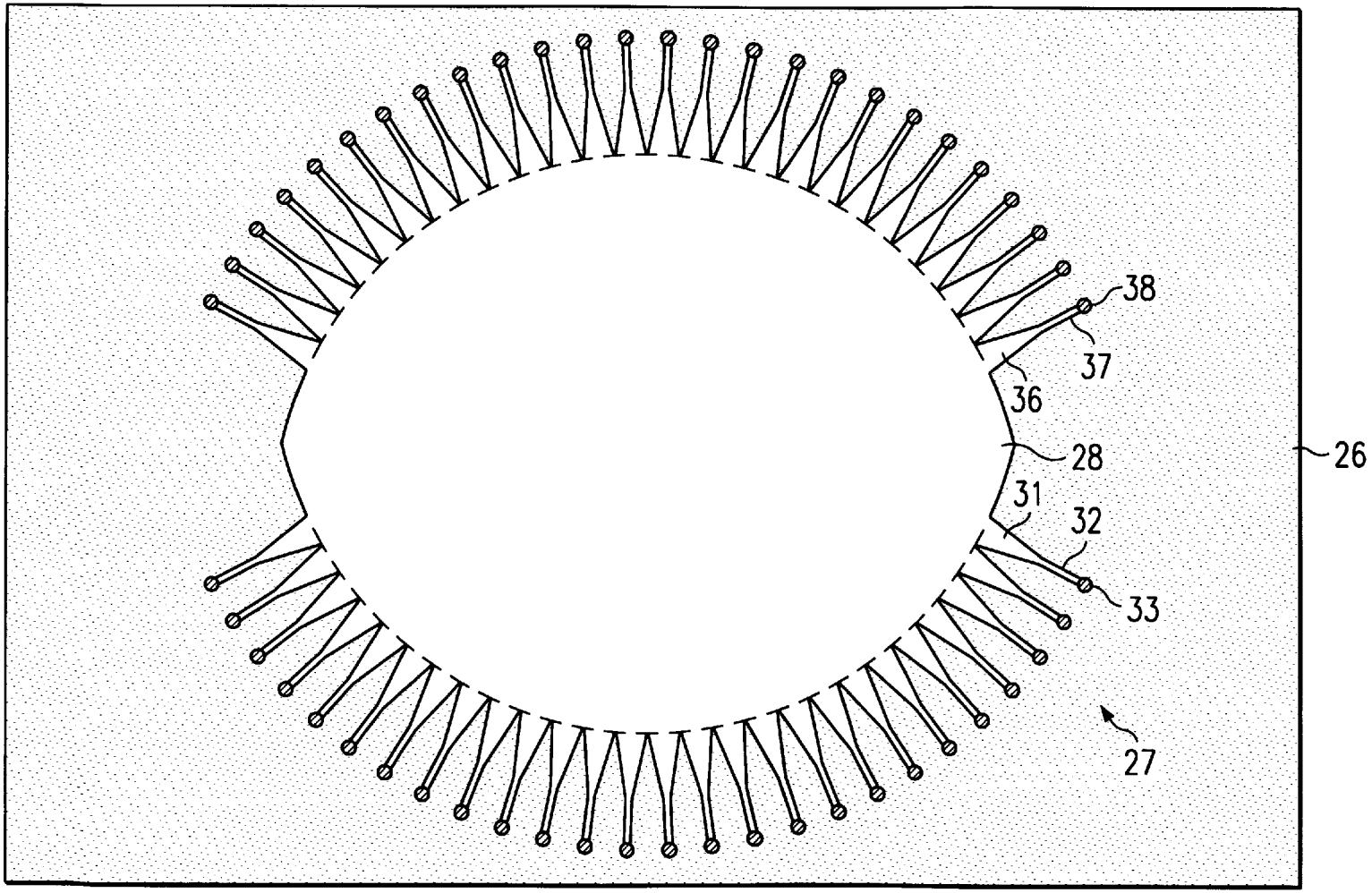
FIG. 2 is a diagrammatic view of an insulating layer which is a component of a selected one of the Rotman lenses of FIG. 1, and which has metalization thereon that includes a lens portion.
Figure 3:
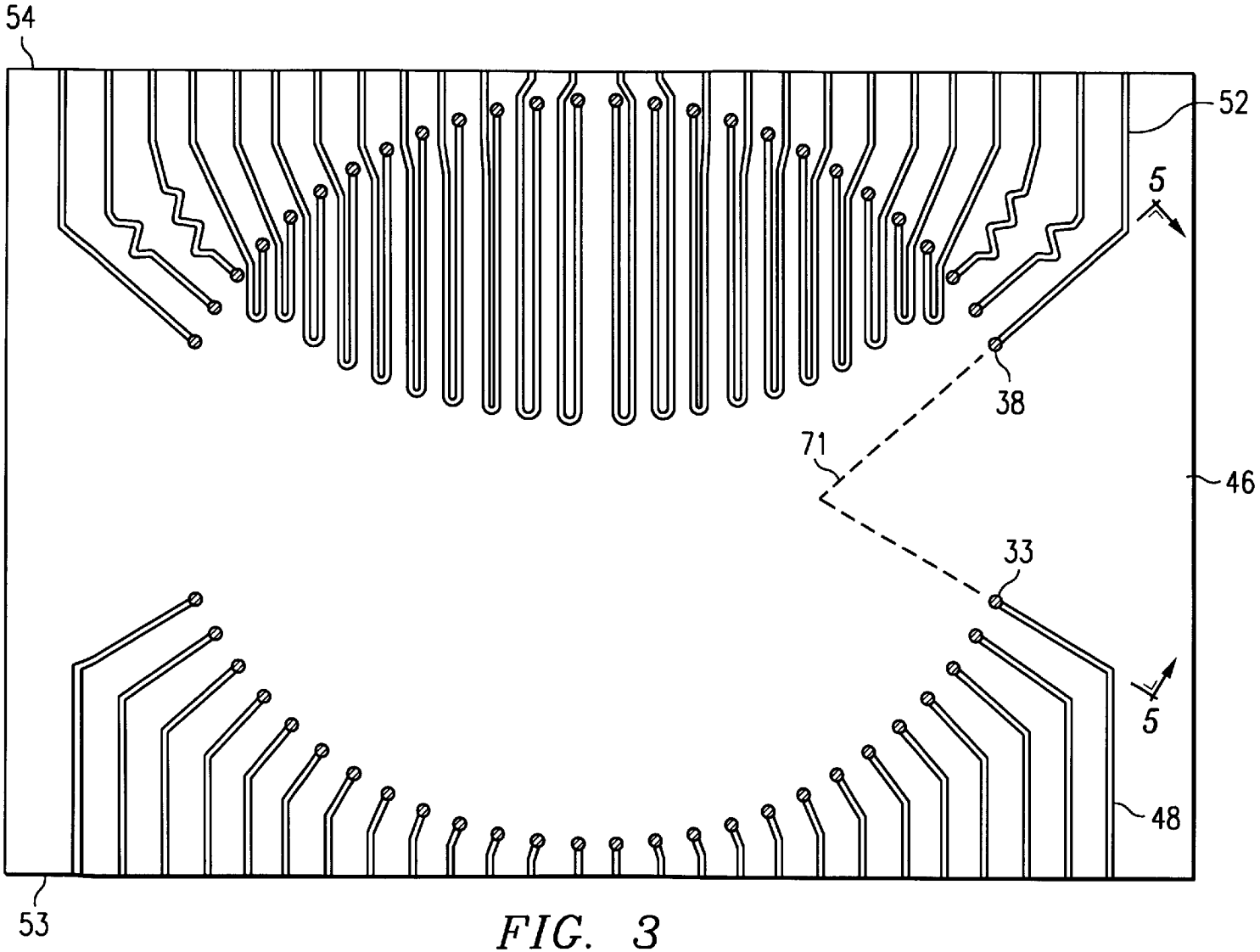
FIG. 3 is a diagrammatic view of a further layer which is a component of the selected Rotman lens of FIGURE 1, and which has metalization thereon defining transmission lines and bootlace lines.
Figure 4:
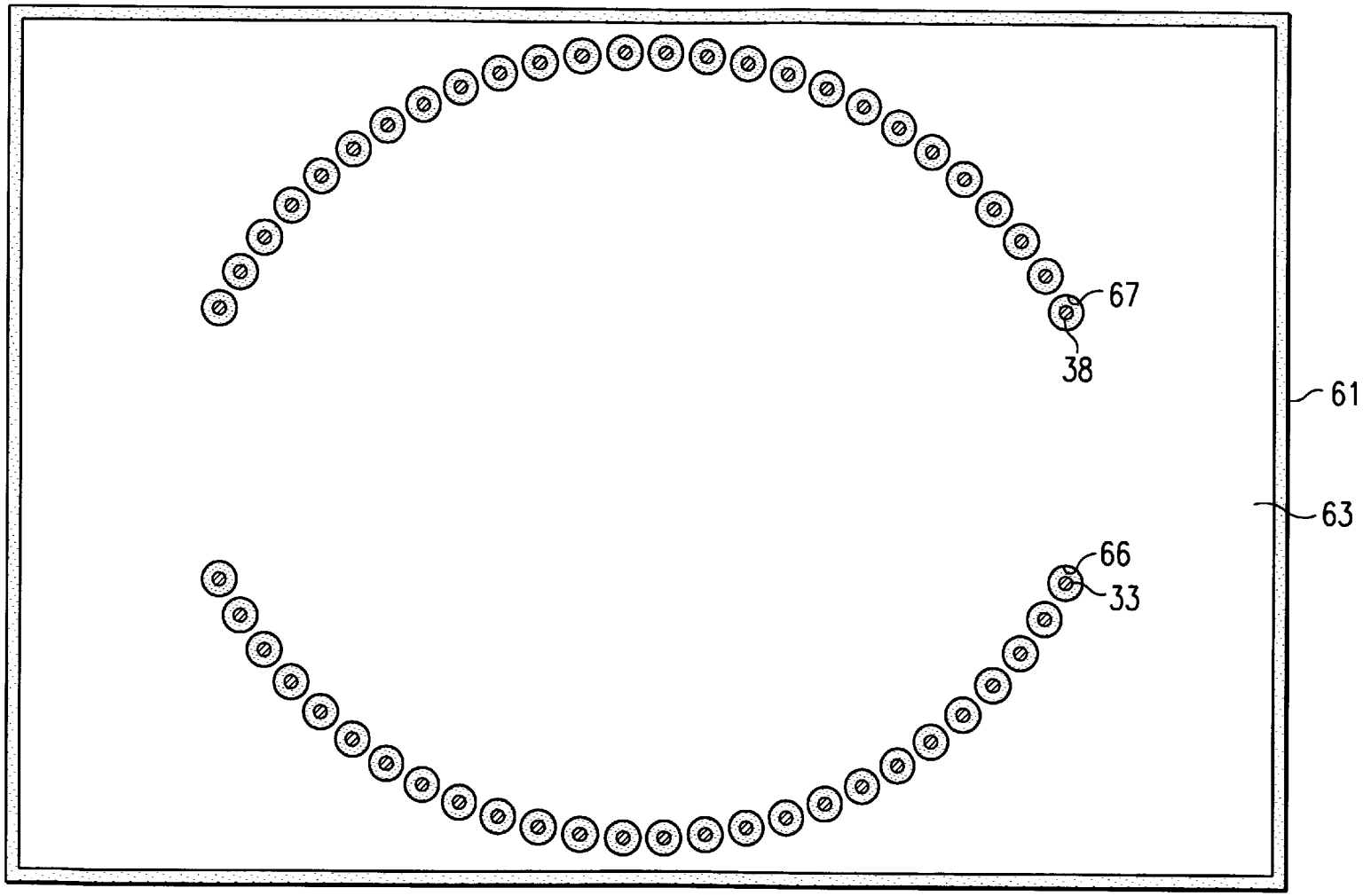
FIG. 4 is a diagrammatic view of a further insulating layer which is a component of the selected Rotman lens of FIG. 1, and which has metalization thereon defining a ground plane.

The selected Rotman lens shown in FIGS. 2–5 is a multi-layer device, respective different layers of which are shown in FIGS. 2, 3 and 4. More specifically, FIG. 2 shows one layer, which includes an electrically insulating layer 26 made of a dielectric material, and a metalization pattern 27 provided on one side thereof. In the disclosed embodiment, the metalization pattern is formed by first depositing an unpatterned metalization layer on one side of the insulating layer 26, and then carrying out a patterned etch so as to leave only the metalization pattern which is shown in FIG. 2.

The metalization 27 in FIG. 2 includes a lens portion 28 having a shape which is approximately oval. A plurality of impedance matching portions 31 are disposed at spaced locations along one side of the lens portion 28, in electrical engagement therewith. A respective short line segment 32 extends away from the outer end of each of the impedance matching portions 31, in electrical engagement therewith. Each impedance matching portion 31 tapers in width in a direction away from the lens portion 28, in order to effect impedance matching between the lens portion 28 and the short line segments 32. The outer end of each short line segment 32 is in electrical engagement with a conductive metal portion or plug 33, which is in turn disposed in a respective via opening provided through the insulating layer 26. The segment of the edge of the lens portion 28 engaged by one of the impedance matching portions is sometimes referred to as a feed port of the lens portion.

A plurality of further impedance matching portions 36 are disposed at spaced locations along the other side of the lens portion 28, in electrical engagement therewith. A respective short line segment 37 extends away from the outer end of each of the impedance matching portions 36, in electrical engagement therewith. Each impedance matching portion 36 tapers in width in a direction away from the lens portion 28, so as to effect impedance matching between the lens portion 28 and the short line segments 37. Each short line segment 37 has an outer end which is in electrical engagement with a conductive metal portion or plug 33, which is in turn disposed in a respective via opening provided through the insulating layer 26.

FIG. 3 is a diagrammatic view of a further layer of the selected Rotman lens. The layer shown in FIG. 3 includes an insulating layer 46 which is made of a dielectric material, and which has metalization thereon in the form of transmission lines 48 and bootlace lines 52. In the disclosed embodiment, the metalization shown at 48 and 52 is formed by depositing an unpatterned metal layer on the insulating layer 46, and then carrying out a patterned etch in order to remove undesired portions of the metalization layer, or in other words so as to leave the desired portions 48 and 52.

Each of the transmission lines 48 extends from an edge 53 of the insulating layer 46 to a respect via opening provided through the insulating layer 46, where it is in electrical contact with the conductive metal 33 disposed in the via opening. This effects an electrical coupling between each transmission line 48 and a respective one of the short line segments 32. Similarly, each of the bootlace lines 52 extends from an edge 54 of the insulating layer 46 to a respective via opening provided through the insulating layer 46, where it is in electrical contact with the conductive metal 38 provided through the via opening. This effects an electrical coupling between each bootlace line 52 and a respective one of the short line segments 37.

The bootlace lines 52 in FIG. 3 each have a length which is selected to provide a desired propagation delay so as to ensure proper operation of the overall Rotman lens, in particular by maintaining accurate relative phase shifts between signals on the respective bootlace lines 52. The bootlace lines 52 of FIG. 3 are therefore each laid out along a respective path which has a U-shape or which meanders, so that each has the appropriate length. It is this path which makes each line look somewhat like a bootlace, which is why they are referred to as bootlace lines. It will be noted that most of the bootlace lines 52 in the disclosed embodiment include a section that effectively overlays the oval-shaped lens portion 28 of FIG. 2. This permits the Rotman lens of the invention to have an overall size which is less than that of a known Rotman lens, where the lens portion and the entirety of the bootlace lines are formed from a single metalization on a single insulating layer.

FIG. 4 is a diagrammatic view of a further layer of the selected Rotman lens, including an insulating layer 61 made of a dielectric material, and having thereon a metalization layer 63. The metalization layer 63 has etched therethrough a plurality of circular openings 66 and 67. Each of the openings 66 has a larger diameter than and concentrically surrounds one of the conductive metal portions or plugs 33, which each extend through a respective via opening provided through the insulating layer 61. Similarly, each of the openings 67 has a larger diameter than and concentrically surrounds one of the conductive metal portions or plugs 38, which each extend through a respective via opening provided through the insulating layer 61. Thus the conductive portions 33 and 38 each extend through the metalization 63 without electrical contact therewith. The metalization 63 serves as a ground plane.

Figure 5:
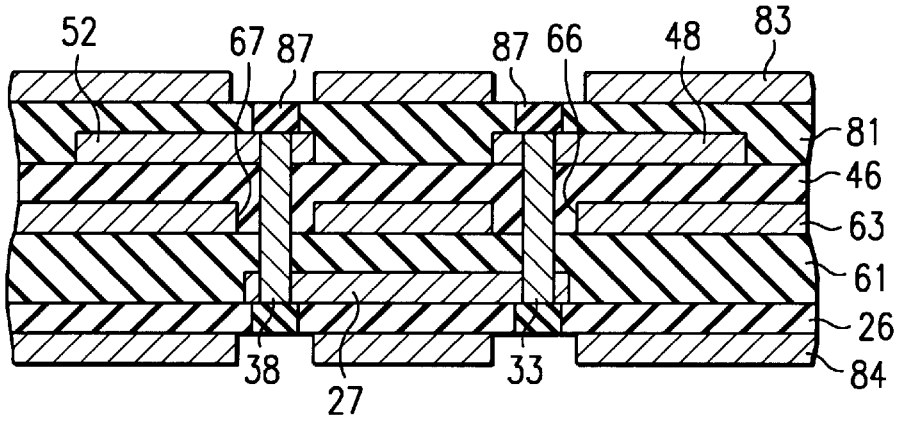
FIG. 5 is a sectional view of a portion of the selected Rotman lens of FIG. 1.

FIG. 5 is a sectional view of the multi-layer Rotman lens embodying the present invention, taken along a line which corresponds to the broken line 71 in FIG. 3. FIG. 5 is not to scale, and it will be recognized that the thicknesses of certain materials have been exaggerated for purposes of clarity. FIG. 5 shows that the insulating layer 61 having the ground plane 63 thereon (FIG. 4), is disposed between the insulating layer 46 having the metalization lines 48 and 52 thereon (FIG. 3), and the insulating layer 26 having the metalization layer 27 thereon (FIG. 2). FIG. 5 also shows the conductive metal portions or plugs 33 and 38 which extend through aligned via openings in the insulating layers 46 and 61, in order to electrically couple the metalization 27 on insulating layer 26 to the metalization lines 48 and 52 on insulating layer 46.

The insulating layers 61 and 46 are sandwiched between the insulating layer 26 and a further electrically insulating layer 81. The layer 81 is made of a dielectric material, and has metalization 83 thereon. The layer 26 has metalization 84 on a side thereof opposite from the metalization 27. The metalizations 83 and 84 each have the same configuration as the metalization 63, and also serve as ground planes.

When the metal portions or plugs 33 and 38 are first formed, they each extend from the top surface of layer 81 to the bottom surface of layer 26. Thereafter, in order to prevent the end portions of the plugs 33 and 38 from radiating radio frequency interference (RFI), both end portions of each are drilled out, so that each extends only from about the top surface of lines 52 and 48 to about the bottom surface of metalization 27, as shown in FIG. 5. Then, each of the drill holes is filled with a dielectric material, for example as shown at 87 in FIG. 5.

Figure 6:
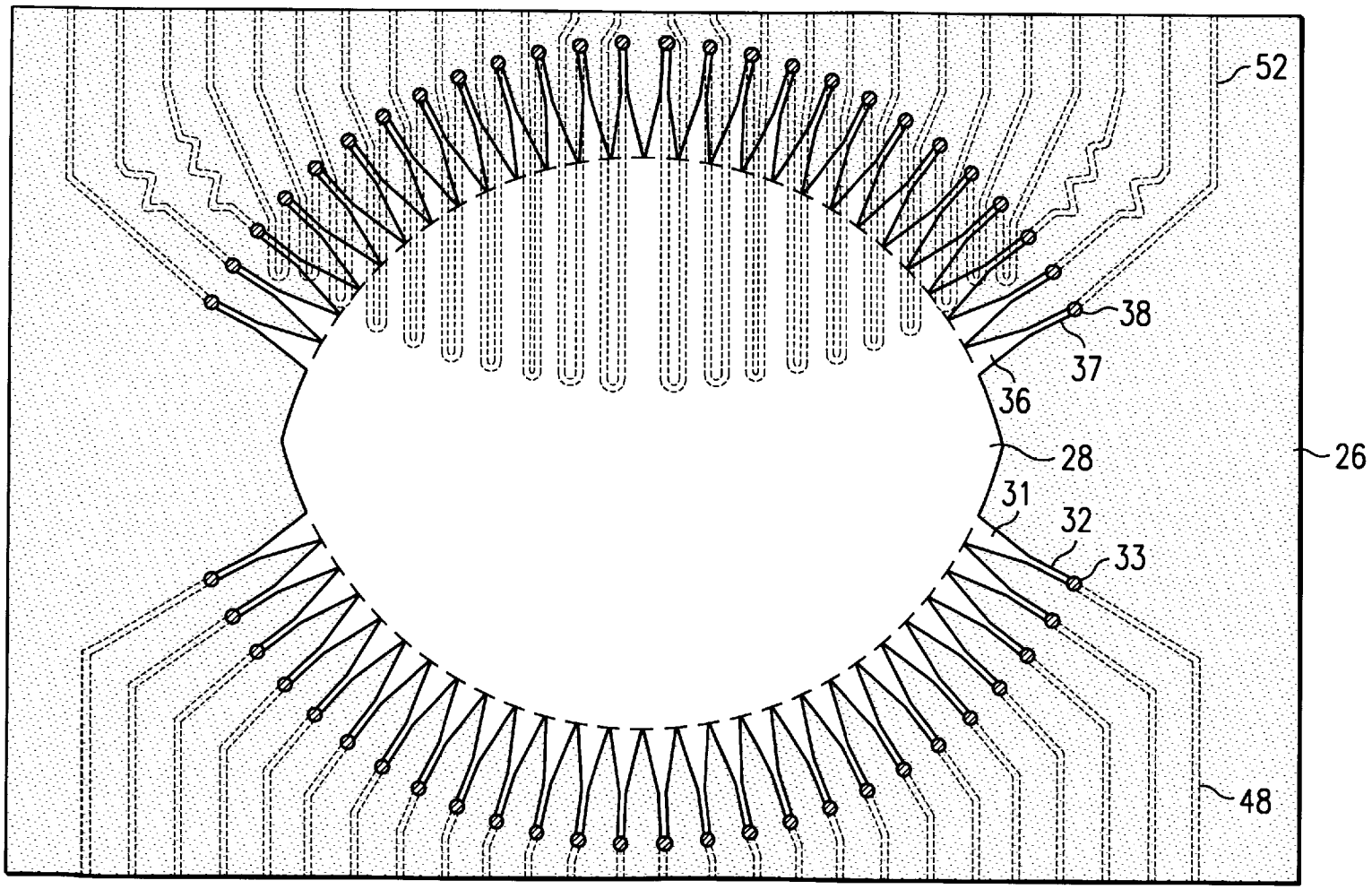
FIG. 6 is a diagrammatic view of the structure of FIG. 2, but with the metalization of FIG. 3 superimposed thereon in broken lines.

FIG. 6 is a diagrammatic view of the structure shown in FIG. 2, including the insulating layer 26 and the metalization 28 thereon, and also shows superimposed thereon in broken lines the transmission lines 48 and bootlace lines 52 from FIG. 3. FIG. 6 shows very clearly how most of the bootlace lines have sections which physically overlap the lens portion 28. Of course, these sections of the bootlace lines 52 are not in electrical contact with the lens portion 28, because of the insulating layers that are located therebetween.

In the disclosed embodiment, the insulating layer 46 shown in FIG. 3 has a low dielectric constant, and the insulating layer 26 shown in FIG. 2 has a high dielectric constant. As known in the art, and as discussed in the introductory portion of this disclosure, the dielectric constant of an insulating layer affects the transmission characteristics of signals propagating through metalization thereon. Further, it affects the ease with which components such as the lens portion and lines can be fabricated on the insulating layer. The disclosed embodiment provides the lens portion 28 on an insulating layer with a high dielectric constant, and provides the transmission lines 48 and bootlace lines 52 on an insulating layer 46 having a low dielectric constant. It is thus possible to optimize the transmission characteristics and ease of fabrication of the lens portion 28 separately from the transmission characteristics and ease of fabrication of the lines 48 and 52. In addition, the use of separate insulating layers permits the Rotman lens according to the invention to be more physically compact than a known Rotman lens.

Figure 7:
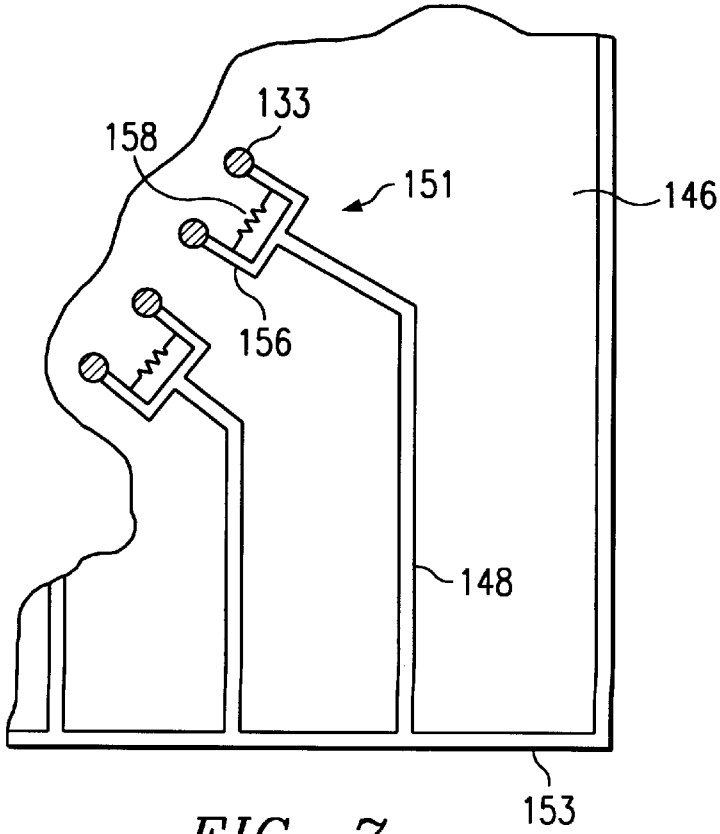
FIG. 7 is a diagrammatic fragmentary view of a portion of an alternative embodiment of the insulating layer and transmission lines shown in FIG. 3.

FIG. 7 is a fragmentary diagrammatic view of part of an alternative embodiment of the structure shown in FIG. 3. More specifically, an electrically insulating layer 146 has a low dielectric constant, and has thereon a transmission line 148 which extends from an edge 153 of the insulating layer 146 to a Wilkinson combiner 151. The Wilkinson combiner 151 has a U-shaped portion 156 with a bight, the middle portion of the bight being electrically coupled to an adjacent end of the transmission line 148. The U-shaped portion also has two legs, which each extend away from a respective end of the bight in the same direction, and which are each electrically coupled at an outer end to conductive metal 133 disposed in a via opening provided through the insulating layer 146. The Wilkinson combiner 151 also includes a resistive portion 158, which extends between the legs of the U-shaped portion 156.

It is known in the art that a Wilkinson combiner is easier to fabricate on an insulating layer with a low dielectric constant than an insulating layer with a high dielectric constant. Since the layer 146 in FIG. 7 has a low dielectric constant, the Wilkinson combiner 151 can be fabricated more easily than would be the case in a known Rotman lens, where it would be fabricated on a layer with a high dielectric constant.

The present invention provides a number of technical advantages. One such technical advantage is that the lens portion is in a metalization layer different from the metalization layer which includes the transmission lines and bootlace lines, as a result of which the bootlace lines can overlap the lens portion without electrical contact therewith (as shown in FIG. 6), thereby allowing a very compact size for the overall Rotman lens. In addition, the metalization for the lens portion can be fabricated on an insulating layer with a high dielectric constant, whereas the metalization for the bootlace lines and transmission lines can be fabricated on an insulating layer with a low dielectric constant, thereby permitting the transmission characteristics of each metalization to be optimized, while also facilitating the ease of manufacture.

The reduction in the overall size of the Rotman lens is advantageous in many applications, for example by reducing the space taken up by the Rotman lens in a satellite, and by permitting a lower profile antenna design in an airborne application. A further advantage is that, due to the use of an insulating material with a low dielectric constant, a device such as a Wilkinson combiner can be easily integrated into the Rotman lens, because its fabrication is easier than would be the case where the lens had only insulating material with a high dielectric constant. As a whole, the Rotman lens embodying the invention provides more degrees of design freedom, simplifies manufacturing considerations, and minimizes the overall width and height or "depth" of the Rotman lens.

Although two embodiments have been illustrated and described in detail, it should be understood that various substitutions and alterations can be made therein with departing from the scope of the present invention. For example, although the transmission lines and bootlace lines are created on the same insulating layer, by etching a common metalization, it would be possible to provide them on different insulating layers. In this regard, the transmission lines could be provided on the same layer as the lens portion. Alternatively, the bootlace lines, the transmission lines and the lens portion could all provided on respective different insulating layers. Other changes are also possible without departing from the spirit and scope of the present invention, as defined by the following claims.

What is claimed is:

1. An apparatus, comprising:

an electrically conductive lens portion;

a plurality of electrically conductive lines, said electrically conductive lines including a first line and a plurality of second lines, said first line being electrically coupled at one end to said lens portion on a first side thereof, and said second lines being electrically coupled at one end to said lens portion at spaced locations along a second side thereof opposite from said first side; and an electrically insulating layer located between said lens portion and at least one of said electrically conductive lines.

2. An apparatus according to claim 1, wherein said insulating layer serves as a first insulating layer, and including a second insulating layer made of an electrically insulating material, said lens portion being provided on one of said first and second insulating layers and said one of said electrically conductive lines being provided on the other thereof; and wherein the insulating layer having said lens portion thereon has a dielectric constant which is higher than a dielectric constant of the insulating layer having said one of said electrically conductive lines thereon.

3. An apparatus according to claim 2, including a ground plane disposed between and free of electrical contact with said lens portion and said one of said electrically conductive lines.

4. An apparatus according to claim 2, wherein said first line and all of said second lines are disposed on the insulating layer which has thereon said one of said electrically conductive lines.

5. An apparatus according to claim 4, wherein at least one of said first and second insulating layers has therethrough a plurality of via openings, each of said via openings having therein a conductive material which electrically couples said lens portion to a respective one of said electrically conductive lines.

6. An apparatus according to claim 1, wherein said insulating layer is disposed between said lens portion and all of said second lines.

7. An apparatus according to claim 6, wherein at least one of said second lines has a section which is disposed directly opposite said lens portion.

8. An apparatus according to claim 7, wherein said insulating layer serves as a first insulating layer and has thereon one of said lens portion and each of said second lines, and including a second insulating layer made of an electrically insulating material and having thereon the other of said lens portion and each of said second lines.

9. An apparatus according to claim 8, wherein the insulating layer with said lens portion thereon has a dielectric constant which is higher than a dielectric constant of the insulating layer having the second lines thereon.

10. An apparatus according to claim 8, including a ground plane disposed between and free of electrical contact with said lens portion and said electrically conductive lines.

11. An apparatus according to claim 8, wherein said first line is disposed on the insulating layer which has said second lines thereon.

12. An apparatus according to claim 11, wherein at least one of said first and second insulating layers has therethrough a plurality of via openings which each contain a conductive material that electrically couples said lens portion to a respect one of said electrically conductive lines.

13. An apparatus according to claim 6, wherein a plurality of said second lines each have a section which is disposed directly opposite said lens portion.

14. An apparatus according to claim 1, wherein said insulating layer is disposed between said lens portion and each of said electrically conductive lines.

15. An apparatus according to claim 1, wherein each of said electrically conductive lines includes, at an end thereof adjacent said lens portion, an impedance matching section which tapers progressively in width in a direction away from said lens portion.

16. An apparatus according to claim 1, wherein said electrically conductive lines include a plurality of said first lines which are each electrically coupled at one end to said lens portion at spaced locations along said first side thereof.

* * * * *